US008962226B2

(12) United States Patent
Maeda et al.

(10) Patent No.: US 8,962,226 B2
(45) **Date of Patent: *Feb. 24, 2015**

(54) ORGANIC PHOTORECEPTOR, IMAGE FORMING APPARATUS, AND PROCESS CARTRIDGE

(75) Inventors: Seisuke Maeda, Tokyo (JP); Takeshi Ishida, Tokyo (JP); Masahiko Kurachi, Tokyo (JP); Toshiyuki Fujita, Tokyo (JP); Seijiro Takahashi, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 921 days.

This patent is subject to a terminal disclaimer.

(21) Appl. No.: 12/853,873

(22) Filed: Aug. 10, 2010

(65) Prior Publication Data

US 2011/0045391 A1 Feb. 24, 2011

(30) Foreign Application Priority Data

Aug. 19, 2009 (JP) ..... 2009189835

(51) Int. Cl.
*G03G 5/04* (2006.01)
*G03G 21/18* (2006.01)
*G03G 5/147* (2006.01)

(52) U.S. Cl.
CPC ..... *G03G 21/1814* (2013.01); *G03G 5/14704* (2013.01); *G03G 5/14717* (2013.01); *G03G 5/14734* (2013.01); *G03G 5/14773* (2013.01); *G03G 5/14791* (2013.01)
USPC ..... 430/66

(58) Field of Classification Search
USPC ..... 430/66
See application file for complete search history.

(56) References Cited

U.S. PATENT DOCUMENTS

| | | | | |
|---|---|---|---|---|
| 5,252,418 | A * | 10/1993 | Ishikawa et al. | 430/67 |
| 5,912,098 | A * | 6/1999 | Tanaka et al. | 430/67 |
| 6,248,490 | B1 * | 6/2001 | Suzuki et al. | 430/69 |
| 8,404,417 | B2 * | 3/2013 | Fujita et al. | 430/66 |
| 2007/0065741 | A1 * | 3/2007 | Iemura et al. | 430/60 |
| 2008/0063960 | A1 * | 3/2008 | Hayata et al. | 430/58.05 |

FOREIGN PATENT DOCUMENTS

JP 6118681 4/1994

(Continued)

OTHER PUBLICATIONS

Translation of JP 2003098712 published Apr. 4, 2003.*
Japanese Office Action, Written Notice of Ground of Rejection, Patent Application No. 2009-189835, date of drafting Sep. 17, 2012 (2 pages).

(Continued)

*Primary Examiner* — Peter Vajda
*Assistant Examiner* — Olatunji Godo
(74) *Attorney, Agent, or Firm* — Lucas & Mercanti, LLP

(57) ABSTRACT

An organic photoreceptor, comprises: a conductive support; a photosensitive layer provided on the conductive support; and a protective layer provided on the photosensitive layer, wherein the protective layer contains alumina particles which contain 2 to 50 ppm of phosphorus atoms and is subjected to a surface treatment with a compound A having a reactive functional group and a curable compound B, and the protective layer is a cured layer including a cured product material formed by at least the compound A on the surfaces of the alumina particles and the curable compound B.

13 Claims, 3 Drawing Sheets

(56) References Cited

FOREIGN PATENT DOCUMENTS

| | | | | |
|---|---|---|---|---|
| JP | 2001125297 | | 5/2001 | |
| JP | 2003098712 | | 4/2003 | |
| JP | 2003098712 A | * | 4/2003 | ..... G03G 5/147 |
| JP | 2003-207919 | | 7/2003 | |
| JP | 2010-164646 | | 7/2010 | |

OTHER PUBLICATIONS

English translation of Japanese Office Action, Written Notice of Ground of Rejection, Patent Application No. 2009-189835, date of drafting Sep. 17, 2012 (2 pages).

* cited by examiner

ORGANIC PHOTORECEPTOR, IMAGE FORMING APPARATUS, AND PROCESS CARTRIDGE

This application is based on Japanese Patent Application No. 2009-189835 filed on Aug. 19, 2009, in Japanese Patent Office, the entire content of which is hereby incorporated by reference.

TECHNICAL FIELD

The present invention relates to an organic photoreceptor for use in image forming apparatuses with an electro-photographic system, an image forming apparatus employing the organic photoreceptor and a process cartridge.

BACKGROUND ART

In recent years, as an electro-photographic photoreceptor, organic electro-photographic photoreceptors (hereafter, referred to as organic photoreceptors or also merely referred to as photoreceptors) containing organic photoconductive materials are most widely used. As compared with other type photoreceptors, the organic photoreceptors have advantageous points, such as, it is easy to develop materials corresponding to various exposure light sources from visible light to infrared light, it is possible to select materials free from environmental pollution, and manufacturing cost is cheap. However, the organic photoreceptors have problems, such as, mechanical strength is weak, deterioration or blemish tend to take place on their surfaces at the time of copying or printing a number of sheets.

As an assignment for improving the durability of the organic photoreceptors, a structure to suppress abrasion due to scratch of a cleaning blade has been required strongly. As approach for such a structure, a technique to provide a protective layer with high strength on the surface of a photoreceptor has been studied. For example, as a surface layer of a photoreceptor, a technique to employ a colloidal silica-containing curable siloxane resin is reported (Patent Document 1). In the colloidal silica-containing curable siloxane resin, the curable resin with a siloxane bond (Si—O—Si bond) and also the colloidal silica have a high hygroscopic property. Therefore, the electric resistance of the surface layer falls easily, and image blurring and image flowing tend to take place.

Further, as a curable resin applied to a protective layer, a protective layer of a curable resin obtained by photo-polymerization with the use of a compound having an acryloyl group is proposed (Patent Document 2). In the protective layer, filler such as a metal oxide are contained in the curable resin. However, binding between the filler and the curable resin is weak, the intensity as a protective layer is insufficient, and problems such as image blurring and image flowing cannot be solved yet sufficiently.

Furthermore, it is reported that alumina particles of a trigonal system as filler contained in a protective layer are effective to improve image blurring (Patent Document 3). However, in this protective layer, binding between the alumina particles and a binder resin in the protective layer is weak, uniform dispersion of the alumina particles in the protective layer becomes insufficient, and the strength as the protective layer is weak. Accordingly, poor cleaning occurs. As a result, problems of image blurring cannot be solved sufficiently.

Moreover, if alumina particles sold on the commercial market are used for the alumina particles, deterioration of electric potential characteristics is observed together with image blurring when the photoreceptor is used repeatedly. As a result, such a phenomenon becomes an obstacle in the case of employing alumina particles as filler of a protective layer.

Patent Document 1: Japanese Unexamined Patent Publication No. 6-118681

Patent Document 2: Japanese Unexamined Patent Publication No. 2001-125297

Patent document 3: Japanese Unexamined Patent Publication No. 2003-98712

SUMMARY OF THE INVENTION

An object of the present invention is to solve the above mentioned problems, to provide an organic photoreceptor in which the abrasion property of the organic photoreceptor is improved to a level equivalent to an amorphous silicone photoreceptor, and which can improve image flowing and image blurring that take place easily under high temperature and high humidity, has high durability and can obtain an electro-photographic image with high quality, and to provide an image forming apparatus and a process cartridge, which employs the organic photoreceptor.

As a result of sorting out the problems of the conventional protective layer applied to an organic photoreceptor, the inventors found that in order to improve abrasion property and to solve image flowing and image blurring under high temperature and high humidity and poor cleaning simultaneously, it is necessary to disperse filler uniformly in curable resin in a protective layer, to make the curable resin and filler to bond with each other strongly, and to provide the curable resin with a hydrophobic property. Then, the inventors have achieved the present invention.

Namely, the above objects can be attained by the following structures.

An organic photoreceptor, comprises:

a conductive support;

a photosensitive layer provided on the conductive support; and a protective layer provided on the photosensitive layer, wherein the protective layer contains alumina particles which contain 2 to 50 ppm of phosphorus atoms and is subjected to a surface treatment with a compound A having a reactive functional group and a curable compound B, and the protective layer is a cured layer including a cured product material formed by at least the compound A on the surfaces of the alumina particles and the curable compound B.

DETAILED DESCRIPTION OF THE PREFERRED EMBODIMENT

Figure 1:
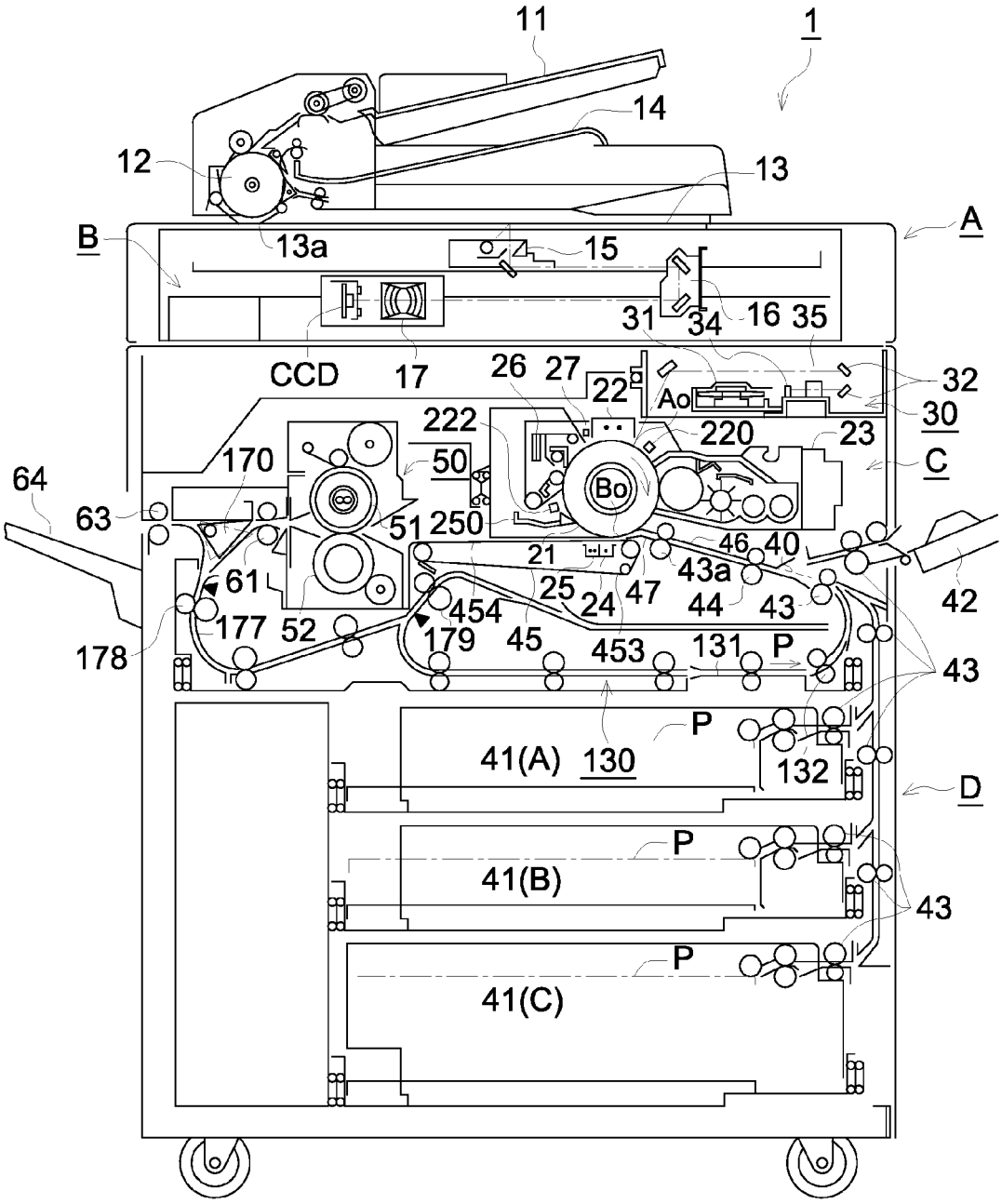
FIG. 1 is an outline view of an image forming apparatus in which an organic photoreceptor of the present invention is incorporated.

Alumina particles subjected to a surface treatment with a compound A having a reactive functional group according to the present invention will be explained.

The abovementioned alumina particles subjected to a surface treatment with a compound A having a reactive functional group can be manufactured by the following procedures.

Namely, the alumina particles can be produced by the reaction between alumina particles and a silane compound represented by the following Formula (1).

Formula (1)

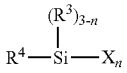

wherein $R^3$ represents a hydrogen atom, an alkyl group having 1 to 10 carbon atoms or an aralkyl group having 1 to 10 carbon atoms, $R^4$ represents an organic group having a polymerizable double bond, X represents a halogen atom, an alcoxy group, an acyloxy group, an aminoxy group or a phenoxy group, and n represents an integer of 1 to 3.

As such a silane compound made to react with alumina particles, as long as a compound has a silyl group, especially a silyl group having hydrolyzability, and in addition, can cause radical polymerization, the compound has no limiation. Hereafter, examples of the silane compound represented by Formula (1) are listed.

S-1 $CH_2{=}CHSi(CH_3)(OCH_3)_2$

S-2 $CH_2{=}CHSi(OCH_3)_3$

S-3 $CH_2{=}CHSiCl_3$

S-4 $CH_2{=}CHCOO(CH_2)_2Si(CH_3)(OCH_3)_2$

S-5 $CH_2{=}CHCOO(CH_2)_2Si(OCH_3)_3$

S-6 $CH_2{=}CHCOO(CH_2)_2Si(OC_2H_5)(OCH_3)_2$

S-7 $CH_2{=}CHCOO(CH_2)_3Si(OCH_3)_3$

S-8 $CH_2{=}CHCOO(CH_2)_2Si(CH_3)Cl_2$

S-9 $CH_2{=}CHCOO(CH_2)_2SiCl_3$

S-10 $CH_2{=}CHCOO(CH_2)_3Si(CH_3)Cl_2$

S-11 $CH_2{=}CHCOO(CH_2)_3SiCl_3$

S-12 $CH_2{=}C(CH_3)COO(CH_2)_2Si(CH_3)(OCH_3)_2$

S-13 $CH_2{=}C(CH_3)COO(CH_2)_2Si(OCH_3)_3$

S-14 $CH_2{=}C(CH_3)COO(CH_2)_3Si(CH_3)(OCH_3)_2$

S-15 $CH_2{=}C(CH_3)COO(CH_2)_3Si(OCH_3)_3$

S-16 $CH_2{=}C(CH_3)COO(CH_2)_2Si(CH_3)Cl_2$

S-17 $CH_2{=}C(CH_3)COO(CH_2)_2SiCl_3$

S-18 $CH_2{=}C(CH_3)COO(CH_2)_3Si(CH_3)Cl_2$

S-19 $CH_2{=}C(CH_3)COO(CH_2)_3SiCl_3$

S-20 $CH_2{=}CHSi(C_2H_5)(OCH_3)_2$

S-21 $CH_2{=}C(CH_3)Si(OCH_3)_3$

-continued

S-22 $CH_2{=}C(CH_3)Si(OC_2H_5)_3$

S-23 $CH_2{=}CHSi(OCH_3)_3$

S-24 $CH_2{=}C(CH_3)Si(CH_3)(OCH_3)_2$

S-25 $CH_2{=}CHSi(CH_3)Cl_2$

S-26 $CH_2{=}CHCOOSi(OCH_3)_3$

S-27 $CH_2{=}CHCOOSi(OC_2H_5)_3$

S-28 $CH_2{=}C(CH_3)COOSi(OCH_3)_3$

S-29 $CH_2{=}C(CH_3)COOSi(OC_2H_5)_3$

S-30 $CH_2{=}C(CH_3)COO(CH_2)_3Si(OC_2H_5)_3$

S-31

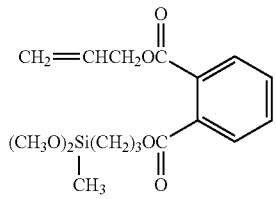

S-32

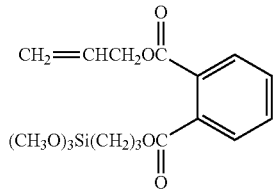

S-33

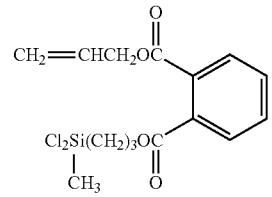

S-34

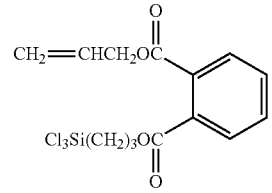

These silane compounds may be used independently, or mixed in the combination of two or more of them.

Producing method of alumina particles subjected to a surface treatment with a compound A having a reactive functional group and containing 2 to 50 ppm of phosphorus atoms The alumina particles according to the present invention can be obtained by a technique of subjecting alumina particles containing 2 to 50 ppm of phosphorus atoms to a surface treatment with a silane compound represented by Formula (1). At the time of conducting such a surface treatment, it is preferable to conduct a surface treatment by the use of a wet type media dispersing apparatus with 0.1 to 100 parts by weight of the silane compound as a surface treating agent and 50 to 5000 parts by weight of solvent for 100 parts by weight of alumina particles.

Hereafter, a surface treating method to produce alumina particles subjected to a surface treatment so as to be covered uniformly and more minutely with a silane compound will be described concretely.

Namely, when a slurry (suspension liquid of solid particles) containing alumina particles and a surface treatment agent of a silane compound is pulverized in a wet process, agglomeration of alumina particles are dispersed and simultaneously a surface treatment for the alumina particles makes progress. Thereafter, the solvent is removed, and the alumina particles are made in the form of powder, whereby it is possible to obtain alumina particles having been subjected to the surface treatment so as to be covered uniformly and finely with the silane compound.

The wet type media dispersing apparatus utilized as the surface treatment apparatus in the present invention has a pulverizing and dispersing process that fills up with beads as a dispersion media in a container and rotates agitation disks mounted perpendicularly on a rotating shaft at high speed in the container so as to pulverize and disperse agglomerated particles of alumina particles. As its structure, if an apparatus can disperse alumina particles sufficiently at the time of conducting a surface treatment for the alumina particles and can conduct the surface treatment, there is no problem. For example, various types, such as a vertical type or horizontal type, and a continuous type or batch type can be employable. Specifically, sand mill, Ultra visco mill, Pearl mill, Grain mill, DINO-mill, Agitator Mill, and Dynamic mill are employable. In these dispersing type apparatus, fine pulverizing and dispersing are conducted with impact crush, friction, shear force, and shear stress by the use of pulverizing media such as balls and beads.

As beads for use in the above sand grinder mill, balls made from raw materials, such as glass, alumina, zircon, zirconia, steel, flint stone, etc. can be used. However, beads made from zirconia or beads made from zircon may be especially desirable. A size of beads is usually about 1 to 2 mm, however, it is preferably 0.3 to 1.0 mm in the present invention.

As a material for a disk and an inner wall of container for use in a wet type media dispersing type apparatus, various materials such as stainless, nylon and ceramics are usable. Specifically, in the present invention, a disk and an inner wall of a container made of ceramics such as zirconia or silicon carbide are preferable.

By the abovementioned wet process, alumina particles having been subjected to a surface treatment with, for example, a silane compound represented by Formula (1) can be obtained.

The alumina particles which were obtained by the above ways and have a reactive functional group form a protective layer by reacting with a curable compound B so as to cause curing.

Namely, as a compound B (a curable compound according to the present invention) to react with the reactive functional group of the alumina particles according to the present invention, and various compounds having a carbon-carbon double bond can be used.

As the abovementioned curable compound B, preferable is a radical polymerizable monomer which polymerizes (harden) upon irradiation with actinic-rays such as ultraviolet rays, electron beams, etc. so as to become resin, such as polystyrene, polyacrylate, etc., generally used as binder resin of a photoreceptor. In radical polymerizable monomers, especially, preferable examples include a styrene type monomer, an acrylic type monomer, a methacrylic type monomer, a vinyltoluene type monomer, a vinyl acetate type monomer, and a N-vinyl-pyrrolidone type monomer.

Among the above monomers, especially, a curable compound B having an acryloyl group or a methacryloyl group is desirable, because it can be cured with a small quantity of light or for a short time.

In the present invention, these curable compounds B may be used solely or mixed as a combination of them.

Examples of the curable compounds B relating to the present invention are shown below.

In the present invention, an acrylic compound is a compound which has an acryloyl group ($CH_2$=CHCO—) or a methacryloyl group (CH2=CCH3CO—). Hereafter, an Ac group number (the number of acryloyl groups) represents the number of acryloyl groups or methacryloyl groups.

| No. | | Ac Number |
|---|---|---|
| (1) | 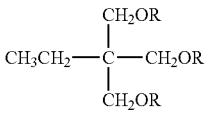 | 3 |
| (2) | 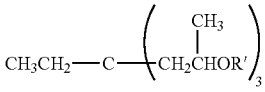 | 3 |
| (3) | 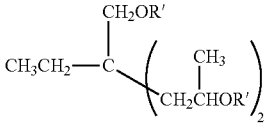 | 3 |
| (4) | 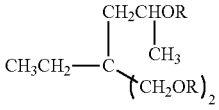 | 3 |

-continued
| No. | | Ac Number |
|---|---|---|
| (5) | $HOCH_2-C(CH_2OR')_3$ | 3 |
| (6) | $HOCH_2-C(CH_2OR)_2-CH_2OCH_2-C(CH_2OR)_2-CH_2OH$ | 4 |
| (7) | $ROCH_2-C(CH_2OR)_2-CH_2OCH_2-C(CH_2OR)_2-CH_2OR$ | 6 |
| (8) | $(R'OCH_2)_3C-CH_2OCH_2-C(CH_2OR')(R'OC_5H_{10}-C(=O))_2$ | 6 |
| (9) | 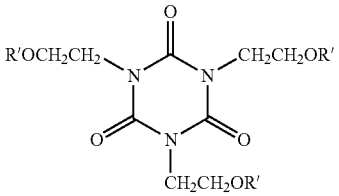 | 3 |
| (10) | $CH_3CH_2C(CH_2OC_3H_6OR)_3$ | 3 |
| (11) | 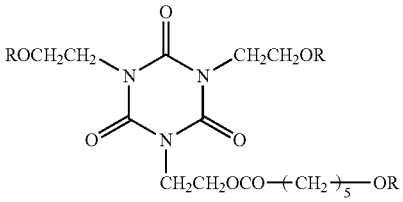 | 3 |
| (12) | $(ROCH_2)_3C-O-C(CH_2OR)_3$ | 6 |
| (13) | $(ROCH_2)_3C-CH_2OCH_2-C(H)(CH_2OR)_2$ | 5 |
| (14) | $(ROCH_2)_3C-CH_2OCH_2-C(CH_3)(CH_2OR)_2$ | 5 |
| (15) | $(ROCH_2)_3C-CH_2OCH_2-C(CH_2OH)(CH_2OR)_2$ | 5 |
| (16) | $(R'OCH_2)_3C-CH_2OCH_2-C(CH_2OR')(CH_2OH)_2$ | 4 |
| (17) | $(ROCH_2)_3C-O-C(CH_2OH)(CH_2OR)_2$ | 5 |

-continued
| No. | | Ac Number |
|---|---|---|
| (18) | 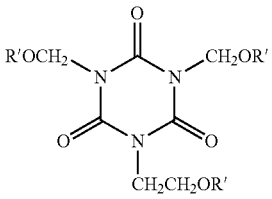 | 3 |
| (19) | $CH_3CH_2—C—(CH_2CH_2OR)_3$ | 3 |
| (20) | $HOCH_2—C—\left(CH_2O—\underset{\underset{O}{\|}}{C}CH_2CH_2CH_2CH_2CH_2OR\right)_3$ | 3 |
| (21) | 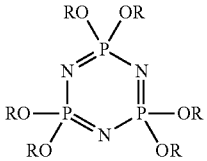 | 6 |
| (22) | 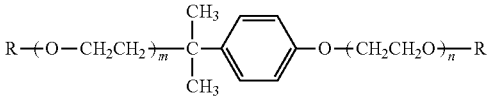 | 2 |
| (23) | 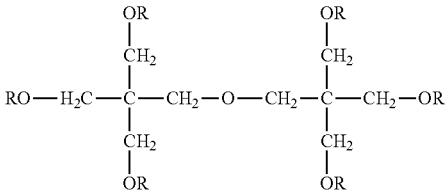 | 6 |
| (24) | 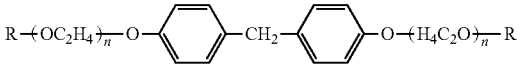 (n ≈ 2) | 2 |
| (25) | 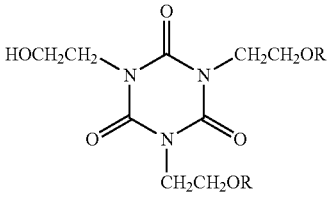 | 2 |
| (26) | $R—(OC_3H_6)_3—OR$ | 2 |
| (27) | 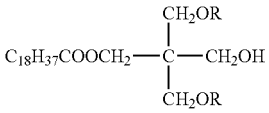 | 2 |
| (28) | 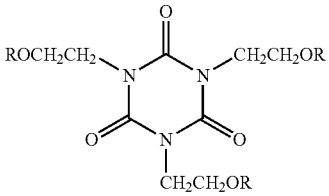 | 3 |

-continued
| No. | | Ac Number |
|---|---|---|
| (29) | $[R-(OC_3H_6)_n-OCH_2)_3-CCH_2CH_3$ (n ≈ 3) | 3 |
| (30) | 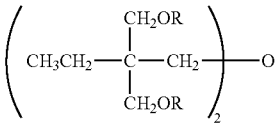 | 4 |
| (31) | $(ROCH_2)_4-C$ | 4 |
| 32 | $RO—C_6H_{12}—OR$ | 2 |
| 33 | 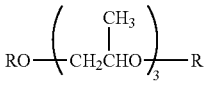 | 2 |
| 34 | 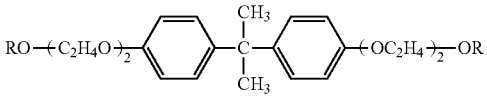 | 2 |
| 35 | 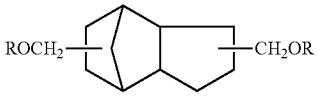 | 2 |
| 36 | $RO-(C_2H_4O)_9-R$ | 2 |
| 37 | 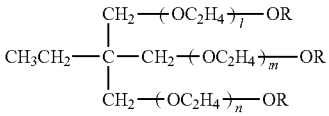 (l + m + n = 3) | 3 |
| 38 | 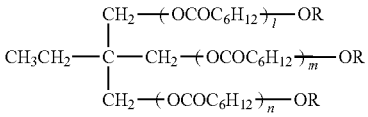 (l + m + n = 3) | 3 |
| 39 | mixture of 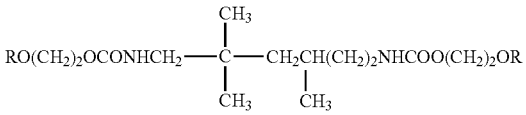 and 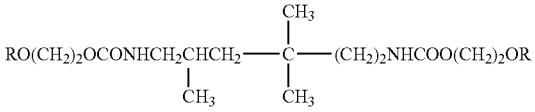 | 2 |
| 40 | $(ROCH_2)_3CCH_2OCONH(CH_2)_6NHCOOCH_2C(CH_2OR)_3$ | 2 |
| 41 | 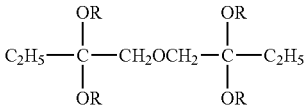 | 4 |

-continued

| No. | | Ac Number |
|---|---|---|
| 42 | 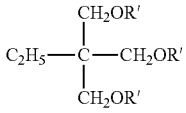 | 3 |
| 43 | 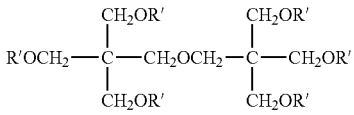 | 6 |
| 44 | 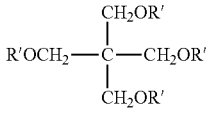 | 4 |

In the above formulas, R and R' is shown below.

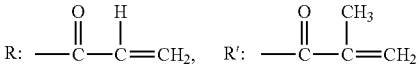

In the present invention, it is desirable that the curable compound B has two or more functional groups, and specifically four or more functional groups. Further, a curable reactive group equivalent weight, that is, "molecular weight of a curable compound/the number of functional groups" is preferably 1000 or less, more preferably 500 or less. With this, crosslinking density becomes high, and the abrasion resistance of a photoreceptor can be improved. If the curable reactive group equivalent weight is larger than the above, some problems may be raised in the high durability of a photoreceptor.

In the present invention, two or more kinds of curable compounds B different in curable reactive group equivalent weight may be used as a mixture of them.

(Producing Method of Alumina Particles Containing 2 to 50 ppm of Phosphorus Atoms)

The alumina particles according to the present invention contain 2 to 50 ppm of phosphorus atoms. Further, the alumina particles preferably contain 5 to 30 ppm of sodium atoms in addition to the phosphorus atoms. The particularly desirable range of the content of the phosphorus atoms is 10 to 40 ppm. When alumina particles contain such a slight amount of phosphorus atoms and the like, it becomes possible to stabilize the electric potential characteristics at the time of repeated use and to avoid the occurrence of image blurring.

There is no clear reason why the content of phosphorus atoms relates to the stability of the electric potential characteristics and the occurrence of image blurring. However, since such a good effect is exhibited particularly when light curing is conducted, it is presumed that UV light at the time of curing and phosphorescence from the phosphorus atoms in alumina particles relate to the degree of progress of curing in the vicinity of particles.

The alumina particles can be obtained by the following ways.

(Adjusting Method of the Content of Phosphorus Atoms or Sodium Atoms)

The alumina particles containing a slight amount of phosphorus atoms and the like according to the present invention can be manufactured by a thermal plasma method employing an arc discharge plasma generating apparatus, for example, as disclosed in Japanese Unexamined Patent Publication No. 11-278828. Namely, an aluminum metal is employed as the material of one electrode of a pair of electrodes, and the thermal plasma method is conducted in such a way that inert gas is filled between the pair of electrodes, then arch discharge is conducted between the pair of electrodes so as to generate plasma flow containing aluminium, thereafter the aluminium in the form of plasma is made to react with oxygen-containing gas which is made to contain phosphorus atoms and sodium atoms in a unit of ppm, whereby alumina particles made to contain a slight amount of phosphorus atoms and sodium atoms according to the invention can be obtained.

Incidentally, alumina in which the content of phosphorus atoms or sodium atoms is adjusted can be obtained from a manufacturer who can manufacture expertly them upon a request.

(Type of Alumina)

There exist various types of alumina due to difference in crystal structure. According to the classification of the crystal structure by X-ray diffraction, the alumina is classified typically into such as α-, β-, γ-, δ-, θ-, and λ-alumina. Examples of alumina employable preferably in the present invention include γ-alumina, δ-alumina, θ-alumina, α-alumina and the like. Among them, γ-alumina is most preferable.

Here, γ-alumina designates not only γ-alumina in the sense of strict meaning, but also γ-alumina in the sense of substantial meaning. The term "γ-alumina in the sense of substantial meaning" means the alumina in which even in the case where other crystal types such as δ-alumina, θ-alumina and the like coexist with γ-alumina, the γ-alumina is the largest crystal type among the all alumina crystal types.

With regard to the crystal analysis of alumina, the crystal type of alumina can be analyzed through the analysis of the intensity of crystal peak by the use of an X-ray diffractometer MINIFLEX (manufactured by Rigaku Corp.).

The number-based 50% particle size of alumina particles usable for the present invention is desirably in the range of 10 to 100 nm. When the particle size is smaller than 10 nm, abrasion resistance is insufficient. On the other hand, when the particle size is large, alumina particles may scatter a writing light beam and disturb light curing so that abrasion resistance may become insufficient.

The number-based 50% particle size of the alumina particles can be obtained such that alumina particles are photographed with an enlarging magnification of 10000 times by a scanning type electron microscope (manufactured by JEOL Ltd.), 300 alumina particles are picked up randomly, their images are taken by a scanner into a photographic image (in which agglomerated particles are eliminated), and then a number-based 50% particle size is calculated from the photographic image by the use of an automatic image processing analysis apparatus LUZEX AP (manufactured by Nireco Corporation) with Software version (Ver.1.32).

The ratio of alumina particles to 100 parts by weight of a curable compound B in a protective layer is 1 to 400 parts by weight, particularly preferably 50 to 250 parts by weight.

The protective layer is formed in such a way that a coating solution is coated to form a coating layer and the coating layer is cured to form a cured layer as the protective layer, wherein in the coating solution, in addition to the curable compound and the alumina particles, a polymerization initiator, filler, lubricant particles, an antioxidant and so on may be blended if needed.

When the curable compound B of the present invention is made to react, a method of inducing reaction with a cleavage reaction by electron rays cleavage, a method of adding a radical polymerization initiator and inducing reaction with light or heat, or the like may be employed. As the polymerization initiator, any one of a photopolymerization initiator and a thermal polymerization initiator may be used. Further, both of the photopolymerization initiator and the thermal polymerization initiator may be used in combination.

As a radical polymerization initiator of these light curable compounds, a photopolymerization initiator is desirable, and among the photopolymerization initiator, an alkyl phenone type compound or a phosphine oxide type compound is desirable. Especially, a compound having an α-hydroxyacetophenone structure or an acyl phosphine oxide structure is desirable. The photopolymerization initiators preferably usable are exemplified below.

Examples of α-amino acetophenone type compounds

Polymerization initiator 1-1

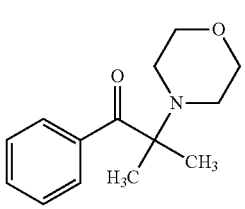

Polymerization initiator 1-2

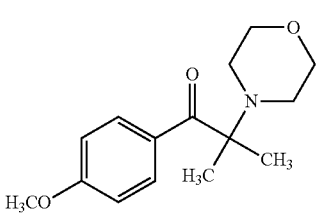

Polymerization initiator 1-3

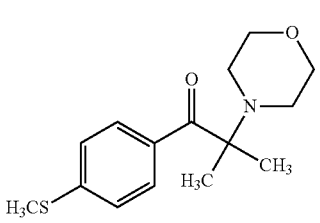

-continued

Polymerization initiator 1-4

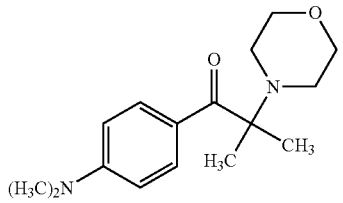

Polymerization initiator 1-5

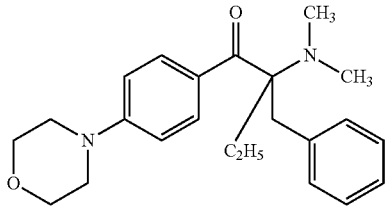

Polymerization initiator 1-6

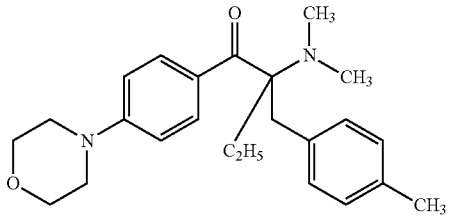

Examples of α-hydroxy acetophenone type compounds

Polymerization initiator 2-1

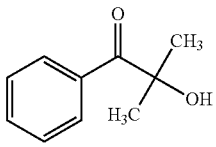

Polymerization initiator 2-2

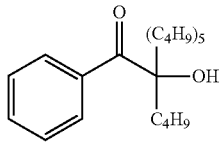

Polymerization initiator 2-3

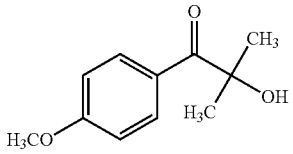

Polymerization initiator 2-4

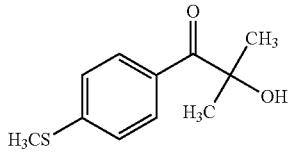

Polymerization initiator 2-5

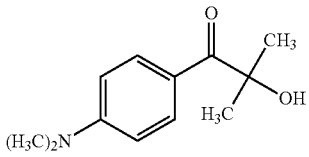

-continued

Polymerization initiator 2-6

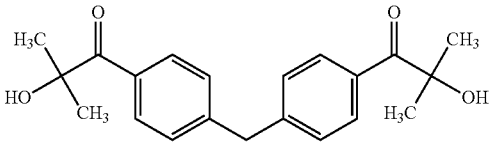

Examples of acyl phosphune oxide type compounds

Polymerization initiator 3-1

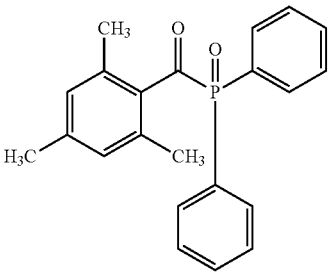

Polymerization initiator 3-2

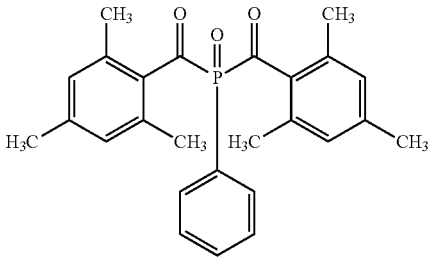

Examples of other radical polymerization initiators

Polymerization initiator 4-1

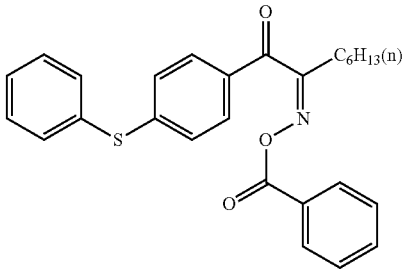

Polymerization initiator 4-2

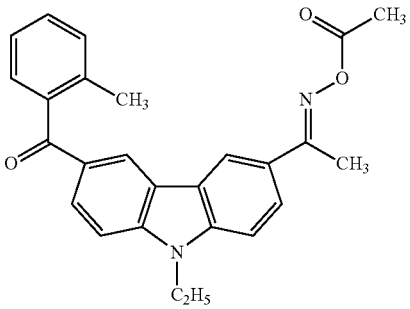

-continued

Polymerization initiator 4-3

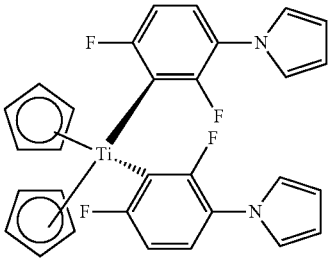

Polymerization initiator 5-1

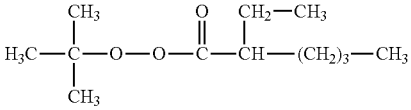

In order to form a protective layer of these light curable resin, a preferable method is that after a coating liquid (the above-mentioned composite) of a protective layer is coated on a photosensitive layer, a first drying process is conducted until a resultant coating layer loses flowability, and then the dried coating layer is cured to form a protective layer by being irradiated with ultraviolet rays, further, a second drying process is conducted so as to make an amount of volatile matter in the coating layer to a specified amount.

As a device to irradiate ultraviolet rays, a well-known device used for curing a ultraviolet curable resin may be employed.

An amount ($mJ/cm^2$) of ultraviolet rays to cure a ultraviolet curable resin is preferably controlled by the irradiation intensity of ultraviolet rays and an irradiation time.

On the other hand as a thermal polymerization initiator, a ketone peroxide type compound, a par oxyketal type compound, a hydro peroxide type compound, a dialkyl peroxide type compound, a diacyl peroxide type compound, a peroxy dicarbonate type compound and a peroxy ester type compound etc. are usable, and these thermal polymerization initiators are disclosed in a product brochure of the company and the like.

In the present invention, as with the above-mentioned photopolymerization initiators, these thermal polymerization initiators are mixed with alumina particle having a reactive functional group according to the present invention or a curable compound B to produce a coating liquid for a protective layer, the resultant coating liquid is coated on a photosensitive layer, and thereafter the coated layer is dried with heating, whereby a protective layer according to the present invention is formed. In the below-mentioned examples, the following thermal polymerization initiator was used as an formation example of a cured protective layer with thermal polymerization.

Thermal polymerization initiator used in examples

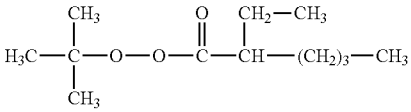

Further, with regard to a coating method of a protective layer, an immersion coating in which the entire body of photoreceptor is immersed in a protective layer coating liquid tends to increase diffusion of polymerization initiator to a lower layer. Therefore, in order to prevent a film of a photosensitive layer under a protective layer from being dissolved, it is preferable to employ a coating processing method, such as an amount regulating type coating technique (a circular slide hopper type as a typical example). The amount regulating type coating technique is disclosed in detail by, for example, JP-A No. 58-189061.

These polymerization initiators may be used solely or as a mixture of two or more kinds. The contained amount of a polymerization initiator may be 0.1 to 20 parts by weight, preferably 0.5 to 10 parts by weight to 100 parts by weight of an acrylic compound.

Further, the protective layer of the present invention may further contain various kinds of charge transport substances.

In the protective layer used in the present invention, various kinds of lubricant particles can be added. For example, resin particles containing fluorine atoms can be added. The resin particles containing fluorine atoms are exemplified by ethylene tetrafluoride resin, ethylene trifluoride resin, ethylene hexafluoride propylene resin, vinyl fluoride resin, vinylidene fluoride resin, and ethylene difluoride dichloro resin. It is preferred that, of these copolymers, one or more should be adequately selected and used. Use of the ethylene tetrafluoride resin, and vinylidene fluoride resin is particular preferred. The amount of the lubricant particles in the surface layer is in the range of 5 to 70 parts by mass, preferably in the range of 10 to 60 parts by mass, with respect to 100 parts by mass of the acrylic compound. The preferred particle diameter of the lubricant particles is such that the average primary particle diameter is 0.01 μm to 1 μm. The particularly preferred average primary particle diameter is 0.05 μm to 0.5 μm. There is no particular restriction to the molecular weight of the resin. A proper molecular weight of the resin can be selected and is not limited specifically.

Examples of solvent for forming the protective layer, without being restricted thereto, include methanol, ethanol, n-propyl alcohol, isopropyl alcohol, n-butanol, t-butanol, sec-butanol, benzyl alcohol, toluene, xylene, methylene chloride, methyl ethyl ketone, cyclohexane, ethyl acetate, butyl acetate, methyl cellosolve, ethyl cellosolve, tetrahydrofuran, 1-dioxane, 1,3-dioxolane, pyridine, and diethyl amine.

In the protective layer of the present invention, it is preferable that after coating and natural drying or heat drying have been conducted, alumina particle having a reactive functional group and a curable compound B are made to cause reaction by being irradiated with actinic rays.

As a coating method, commonly known methods, such as a dip coating method, a spray coating method, a spinner coating method, a bead coating method, a blade coating method, a beam coating method and a slide hopper coating method may be employed.

In the protective layer of the photoreceptor of the present invention, a coating layer is irradiated with actinic rays so as to generate radical to cause polymerization so that crosslinking bonds are formed by a crosslinking reaction among molecules and within a molecule so as to cure the coating layer, whereby it is preferable to produce a cured resin. As the actinic rays, ultraviolet rays and electron beams are specifically desirable.

As an ultraviolet ray source, if a light source generates ultraviolet rays, the light source can be used without restriction. For example, a low pressure mercury lamp, an intermediate pressure mercury lamp, a high pressure mercury vapor lamp, an ultrahigh pressure mercury lamp, a carbon arc lamp, a metal halide lamp, a xenon lamp, a flash (pulse) xenon, etc. can be used. An irradiating condition may change depending on respective lamps. However, an irradiation amount of actinic rays is usually 5 to 500 mJ/cm$^2$, preferably 0.1 kW to 5 kW, and especially preferably 0.5 kW to 3 kW.

As an electron beam source, there is no restriction to an electron beam irradiating apparatus. Generally, as an electron beam accelerator for such electron beam irradiation, a curtain beam type capable of obtaining high power at relatively low cost is effectively employed. An acceleration voltage at the time of electron beam irradiation is preferably in a range of 100 to 300 kV. An absorbed dose is preferably made in a range of 0.5 to 10 Mrad.

An irradiation time to obtain a required amount of actinic rays is preferably in a range of 0.1 sec to 10 minutes, and is more preferably in a range of 0.1 sec to 5 minutes from a viewpoint of working efficiency.

As actinic rays, ultraviolet rays are specifically desirable, because ultraviolet rays can be used easily.

The surface layer of a photoreceptor of the present invention can be subjected to a drying process before and after being irradiated with actinic rays, and while being irradiated with actinic rays, and further a timing to conduct the drying process can be selected appropriately with a combination of these timings.

The condition of the drying process can be suitably selected depending on the kind of solvent of a coating liquid, the thickness of a coating layer, etc. A drying temperature is preferably in a range of room temperature to 180° C., and especially preferably in a range of 80° C. to 140° C. A drying time period is preferably in a range of one minutes to 200 minutes, especially preferably in a range of 5 minutes to 100 minutes.

The thickness of a surface layer is preferably in a range of 0.2 to 10 μm, and more preferably in a range of 0.5 to 6 μm.

[Conductive Support Member]

As far as a support member an electric conductivity, there is no restriction to the support member used in the present invention. Examples of the support member include a drum or sheet formed of such a metal as aluminum, copper, chromium, nickel, zinc and stainless steel; a plastic film laminated with such a metallic film as aluminum and copper; a plastic film provided with vapor deposition of aluminum, indium oxide, and tin oxide; and a metal, plastic film, or paper provided with a conductive layer by coating a conductive substance independently or in combination with a binder resin.

[Intermediate Layer]

In the present invention, an intermediate layer having a barrier function and bonding function can be provided between a conductive layer and a photosensitive layer.

The intermediate layer can be formed in such a way that a binder resin, such as casein, polyvinyl alcohol, nitrocellulose, ethylene-acrylic acid copolymer, polyamide, polyurethane or gelatin is dissolved in a commonly known solvent and the intermediate layer is formed by dip coating with the resultant solution. Among these materials, an alcohol soluble polyamide resin is preferably used.

Further, various kinds of conductive fine particles and metal oxides may be contained in the intermediate layer for an object of adjusting the electric resistance of the intermediate layer. For example, various metal oxides, such as alumina, zinc oxide, titanium oxide, tin oxide, antimony oxide, indium oxide, and bismuth oxide; and ultrafine particles, such as indium oxide doped with tin, tin oxide doped with antimony, and zirconium oxide; may be employed.

These metal oxides may be used solely or as a mixture of two or more kinds. In the case of mixing two or more kinds, the mixture may be in the form of solid dispersion or fusion. The average particle diameter of such a metal oxide is preferably 0.3 μm or less, more preferably 0.1 μm or less.

Solvent used in the intermediate layer is preferably one capable of effective dispersing inorganic particles and dissolving a polyamide resin. Specifically, alcohols having 2 to 4 carbon atoms, such as ethanol, n-propyl alcohol, isopropyl alcohol, n-butanol, t-butanol, and sec-butanol is preferable because of excellence in terms of a dissolving ability for polyamide resin and coating ability. Further, in order to improve storage stability and particle dispersibility, an auxiliary solvent may be used in combination with the aforementioned solvent. Examples of the auxiliary solvent capable of obtaining excellent effects include methanol, benzyl alcohol, toluene, methylene chloride, cyclohexane, and tetrahydrofuran.

The density of a binder resin is selected appropriately in accordance with a layer thickness of the intermediate layer and a production speed.

When inorganic particles are dispersed in the binder resin, the mixed ratio of the inorganic particles is preferably in a range of 20 to 400 parts by mass, more preferably in a range of 50 to 200 parts by mass to 100 parts by mass of the binder resin.

As a dispersing machine of inorganic particles, an ultrasonic homogenizer, a ball mill, a sand grinder, and a homogenizing mixer can be employed, without being restricted thereto.

A method of drying the intermediate layer can be selected appropriately in accordance with a type of solvent and a layer thickness. A method of drying with heat is preferably employed.

The film thickness of the intermediate layer is preferably in a range of 0.1 to 15 μm, more preferably in a range of 0.3 to 10 μm.

[Charge Generation Layer]

A charge generation layer preferably used in the present invention contains a charge generation substance and a binder resin and is formed by coating with a coating solution in which the charge generation substance is dispersed in a binder resin solution.

Examples of the charge generation substance include azo materials such as Sudan Red and Diane Blue; quinone pigments, such as pilene quinone and anthoanthrone; quinocyanine pigments; perylene pigments; indigo pigments, such as indigo, and thioindigo; and phthalocyanine pigments, without being restricted thereto. These charge generation substances can be used independently or in the form of dispersion liquid in which the substances are dispersed in a commonly known resin.

A commonly known resin can be used as the binder resin of the charge generation layer. Examples of such a resin include, without being restricted, polystyrene resin, polyethylene resin, polypropylene resin, acryl resin, methacryl resin, vinyl chloride resin, vinyl acetate resin, polyvinyl butyral resin, epoxy resin, polyurethane resin, phenol resin, polyester resin, alkyd resin, polycarbonate resin, silicone resin, melamine resin, copolymer resin containing two or more of these resins (e.g., vinyl chloride-vinyl acetate copolymer, vinyl chloride-vinyl acetate-anhydrous maleic acid copolymer), and polyvinyl carbazole resin.

The charge generation layer is preferably formed such that a coating solution is prepared by dispersing a charge generation substance by a homogenizer into a solution in which a binder resin is dissolved in a solvent, the prepared coating solution is coated with a predetermined thickness by a coating device, and the resultant coating layer is dried to form the charge generation layer.

Examples of the solvent used for dissolving and coating the binder resin used in the charge generation layer, include toluene, xylene, methylene chloride, 1,2-dichloroethane, methyl ethyl ketone, cyclohexane, ethyl acetate, butyl acetate, methanol, ethanol, propanol, butanol, methyl cellosolve, ethyl cellosolve, tetrahydrazine, 1-dioxane, 1,3-dioxolane, pyridine and diethyl amine, without being restricted thereto.

As a dispersing device for the charge generation substance, an ultrasonic homogenizer, ball mill, sand grinder and homogenizing mixer may be employed, without being restricted thereto.

The mixing ratio of the charge generation substance to the binder resin is preferably in a range of 1 to 600 parts by mass, more preferably in a range of 50 to 500 of the charge generation substance to 100 parts by mass of the binder resin. The film thickness of the charge generation layer differs in accordance with the characteristics of the charge generation substance, the characteristics of the binder resin and the mixing ratio, and is preferably in a range of 0.01 to 5 μm, more preferably 0.05 to 3 μm. When foreign substances and aggregation substances are filtered from a coating solution of the charge generation layer before coating, the occurrence of image defects can be prevented. The charge generation layer can be formed by vacuum evaporation of the aforementioned pigment

[Charge Transport Layer]

A charge transport layer used in the photosensitive layer of the present invention contains a charge transport substance and a binder resin, and is formed by coating with a coating solution in which the charge transport substance is dissolved in a binder resin solution.

Examples of the charge transport substance include carbazole derivative, oxazole derivative, oxadiazole derivative, thiazole derivative, thiadizole derivative, triazole derivative, imidazole derivative, imidazolone derivative, imidazolidine derivative, bisimidazolidine derivative, styryl compound, hydrazone compound, pyrazoline compound, oxazolone derivative, benzoimidazole derivative, quinazoline derivative, benzofuran derivative, acridine derivative, phenazine derivative, aminostilbene derivative, triaryl amine derivative, phenylene diamine derivative, stilbene derivative, benzidine derivative, poly-N-vinyl carbazole, poly-1-vinyl pyrene, and poly-9-vinyl anthracene. Two or more kinds of these substances may be mixed in the binder resin solution.

As a charge transporting substance (CTM), it is desirable to use a charge transporting substance with an atomic weight ratio of N atom being 4.5% or less. As a fundamental structure of the charge transportation material, triphenylamine derivatives, styryl compounds, benzidine compounds, and butadiene compounds may be used. Among these compounds, styryl compounds are specifically preferable.

A well known resin can be used as the binder resin for the charge transport layer. Examples of the resin include polycarbonate resin, polyacrylate resin, polyester resin, polystyrene resin, styrene-acrylnitryl copolymer resin, polymethacrylate ester resin, and styrene-methacrylate ester copolymer. Polycarbonate may be preferably used. Further, BPA, BPZ, dimethyl BPA, and BPA-dimethyl BPA copolymers are preferably used because of excellence in terms of crack resistance, wear resistance, and charging characteristics.

The charge transport layer is preferably formed such that a coating solution is prepared by dissolving binder resin and a charge transport substance, the resultant coating solution is then coated with a predetermined thickness by coater, and the coating layer is dried so as to form the charge transport layer.

Examples of solvent for dissolving the binder resin and the charge transport substance include toluene, xylene, methylene chloride, 1,2-dichloroethane, methyl ethyl ketone, cyclohexane, ethyl acetate, butyl acetate, methanol, ethanol, propanol, butanol, tetrahydrofuran, 1,4-dioxane, 1,3-dioxolane, pyridine, and diethyl amine, without being restricted thereto.

The mixing ratio of the charge transport substance to the binder resin is preferably in a range of 10 to 500 parts by mass, more preferably in a range of 20 to 100 parts by mass of the charge transport substance to 100 parts by mass of the binder resin.

The film thickness of the charge transport layer differs in accordance with the characteristics of the charge transport substance, the characteristics of the binder resin and a mixing ratio, however, it is preferably 5 to 40 μm, more preferably 10 to 30 μm.

An antioxidant, electronic conductive agent, and stabilizer can be added to the charge transport layer. The antioxidants disclosed in Japanese Patent Application No. HEI 11-200135, and electronic conductive agents listed in Japanese Unexamined Publication Nos. 50-137543 and 58-76483 are preferably used.

Next, an image forming apparatus employing an organic photoreceptor according to the present invention will now be described.

An image forming apparatus 1 shown in FIG. 1 is an image forming apparatus based on a digital type and composed of an image reading section A, image processing section B, image forming section C, and transfer paper conveying section D as a transfer paper conveying member.

An automatic document feeding member to automatically convey an original document is arranged in the upper part of the image reading section A. Original documents mounted on a document stacking table 11 are conveyed, while being separated sheet by sheet by a document conveying roller 12, to carry out image reading at a reading position 13*a*. The original document, having been subjected to document reading, is discharged onto a document discharging tray 14.

On the other hand, the image of the original document placed on a platen glass 13 is read by a reading operation at a rate of v in the first mirror unit 15 composed of an illuminating lamp and a first mirror constituting an optical scanning system and by movement at a rate of v/2 in the same direction of second mirror unit 16 composed of a second mirror and a third mirror which are arranged in the form of "V" letter.

The read image is focused through a projection lens 17 onto the light receiving surface of an imaging sensor CCD which is a line sensor. The linear optical image, which has been focused onto the imaging sensor CCD, is successively subjected to a photoelectric conversion into electric signals (brightness signals), and then is subjected to an A/D conversion. The resulting signals are subjected to various processes such as a density conversion and filtering processing in the image processing section B, and thereafter, the resulting image data are temporarily stored in a memory.

In the image forming section C, there are arranged, as image forming units, a drum-shaped photoreceptor 21 which is an image carrier, and on the outer circumference thereof, a charging member (charging process) 22 to charge the above photoreceptor 21, a potential detecting member 220 to detect the surface potential of the charged photoreceptor, a developing member (developing process) 23, a transfer conveyance belt unit 45 as a transferring member (transferring process), a cleaning unit 26 (cleaning process) of the above photoreceptor 21, and a PCL (pre-charge lamp) 27 as a light discharging member (light discharging process) in the order of respective movement. Further, a reflective density detecting member 222 to measure the reflective density of a patch image developed on the photoreceptor 21, is provided on the downstream side of the developing member 23. As the photoreceptor 21, an organic photoreceptor according to the present invention is used and is rotationally driven clockwise as shown in the drawing.

The rotating photoreceptor 21 is uniformly charged by the charging member 22, and image exposure is carried out based on image signals read out by an exposure optical system as an image exposure member (image exposure process) 30 from the memory in the image processing section B. The exposure optical system as the image exposure member 30, which is a writing member, employs a laser diode as a light emitting source, although being not shown in the drawing, and a primary scanning is performed with light along an optical passage bent by a reflection mirror 32 via a rotating polygon mirror 31, a fθ lens 34, and a cylindrical lens 35, whereby an image exposure is performed at the position of Ao against the photoreceptor 21 so as to form an electrostatic latent image via rotation (secondary scanning) of the photoreceptor 21. In an example of the embodiments of the present invention, an electrostatic latent image is formed via exposure on the letter portion.

In the image forming apparatus of the present invention, when an electrostatic latent image is formed on a photoreceptor, a semiconductor laser or a light-emitting diode of an oscillation wavelength of 350 to 500 nm is used as an image exposure light source. Using such an image exposure light source, the exposure dot diameter in the primary scanning direction of writing is narrowed to 10 to 100 μm, and digital exposure is performed on an organic photoreceptor to obtain an electrophotographic image at an enhanced resolution of 400 dpi or more (dpi: the number of dots per 2.54 cm) to 2500 dpi.

The above exposure dot diameter refers to an exposure beam length (Ld: the maximum length is measured) in the primary scanning direction in an area in which the intensity of the exposure beam is at least $1/e^2$ of the peak intensity.

As a source of light beams, a scanning optical system employing a semiconductor laser and an LED solid scanner may be used. A light intensity distribution includes Gaussian distribution and Lorentz distribution, and the exposure dot diameter of the present invention is designated for each area having a peak intensity of at least $1/e^2$.

An electrostatic latent image on photoreceptor 21 is reversely developed by developing member 23 to form a toner image, being a visual image, on the surface of photoreceptor 21.

An electrostatic latent image formed on the organic photoreceptor of the invention is visualized to a toner image by developing. Toner for developing electrostatic image may be a grinded toner and a polymerized toner. A polymerized toner produced by polymerization method is preferably used as the toner of the invention, because of its stable particle diameter distribution.

Polymerized toner is defined as a toner whose shape is formed by polymerization of raw material monomer of binder resin and by a chemical treatment after polymerization as appropriate. Specifically the polymerized toner includes a toner formed by polymerization such as suspension polymerization and emulsion polymerization and as appropriate by particle fusion process thereafter.

The volume average particle diameter of the toner of the present invention is 2.0 to 9.0 μm, preferably 3.0 to 7.0 μm in terms of 50% volume particle diameter described below (Dv50). When the average particle diameter of the toner falls within the above range, high resolution can be obtained. Further by combining small diameter toner within above range, there is decreased the number of fine toner particles, resulting in enhanced dot image quality and enhanced sharpness and stable image in long term.

The toner of the present invention may be used in any of a single-component type developer or a two-component type developer.

AS for a single-component developer, the toner is used as a single-component non-magnetic developer, or a single-component magnetic developer incorporating a magnetic particles of 0.1 to 0.5 μm in toner.

As carrier constituting the two-component developer, usable are magnetic particles composed of conventionally known materials including metals such as iron, ferrite, or magnetite or alloys of the above metals with metals such as aluminum or lead. Specifically ferrite particles are preferably used. The volume average particle diameter of the carrier is preferably 15 to 100 μm, more preferably 25 to 80 μm.

It is possible to determine the volume average particle diameter of a carrier, typically, using laser diffraction system particle diameter distribution meter "HELOS" (produced by Sympatec Co.) equipped with a wet type homogenizer.

Preferable examples of the carrier include a carrier further coated with a resin or a so-called resin dispersion type carrier prepared by dispersing magnetic particles in a resin. Examples of resin compositions for such coating include, without being specifically limited, for example, an olefin based resin, a styrene based resin, a styrene-acrylic based resin, a silicone based resin, an ester based resin, and a fluorine-containing polymer based resin. As a resin constituting the resin dispersion type carrier, any well known resin may be used without being limited thereto, and examples of resins include, for example, a styrene-acrylic based resin, a polyester resin, a fluorine based resin, and a phenol based resin.

In the transfer paper conveying section D, paper feeding units 41(A), 41(B), and 41(C) are arranged as a transfer paper storing member in which sheets of transfer paper P of different size are stored in the lower part of an image forming unit, and manual paper feeding unit 42 is also arranged on the side to manually feed paper. Transfer paper P selected from any thereof is fed along conveying path 40 by guide roller 43. Then, transfer paper P is temporarily stopped by a pair of paper feeding and registration rollers 44 to correct the slant or deviation of fed transfer paper P and then is re-fed, being thereafter guided into conveying path 40, pre-transfer roller 43*a*, paper feeding path 46, and entering guide plate 47. Then, a toner image on photoreceptor 21 is transferred on transfer paper P while being mounted and conveyed on transfer conveyance belt 454 of transfer conveyance belt unit 45 at transfer position Bo by transfer pole 24 and separation pole 25. Transfer paper P is then separated from the surface of photoreceptor 21 and transferred to fixing member 50 by transfer conveyance belt unit 45.

The fixing member 50 has fixing roller 51 and pressurization roller 52, and fixes toner via heating and pressurization by allowing transfer paper P to pass between fixing roller 51 and pressurization roller 52. The transfer paper P having been subjected to toner image fixing is discharged onto paper discharging tray 64.

In the above, an image formation conducted onto one side of transfer paper has been explained. In the case of duplex copying, paper discharge switching member 170 is switched and transfer paper guide section 177 is opened to convey transfer paper P in the dashed arrow direction.

Further, transfer paper P is conveyed downward by conveying mechanism 178 and switched back by transfer paper turnaround section 179, and then conveyed into the inside of duplex copying paper feeding unit 130 while the end portion of transport paper P is switched to the top portion.

The transfer paper P is shifted toward the paper feeding direction through conveying guide 131 arranged in duplex copying paper feeding unit 130, and then re-fed by paper feeding roller 132 to guide transfer paper P into conveying path 40.

The transfer paper P is conveyed again toward photoreceptor 21 as described above. Then, a toner image is transferred on the rear surface of transfer paper P, fixed by fixing member 50, and then discharged onto paper discharging tray 64.

The image forming apparatus of the present invention may be constituted in such a manner that components such as a photoreceptor, a developing unit, and a cleaning unit described above are combined into a unit as a process cartridge, and then the unit may be structured so as to be fully detachable to the apparatus main body. Further, it is possible to employ the following constitution: a process cartridge is formed holding at least one of a charging unit, an image exposure unit, a developing unit, a transfer or separation unit, and a cleaning unit together with a photoreceptor to form a single unit fully detachable to the apparatus main body in such a manner that the unit is fully detachable using a guide member such as a rail of the apparatus main body.

Figure 2:
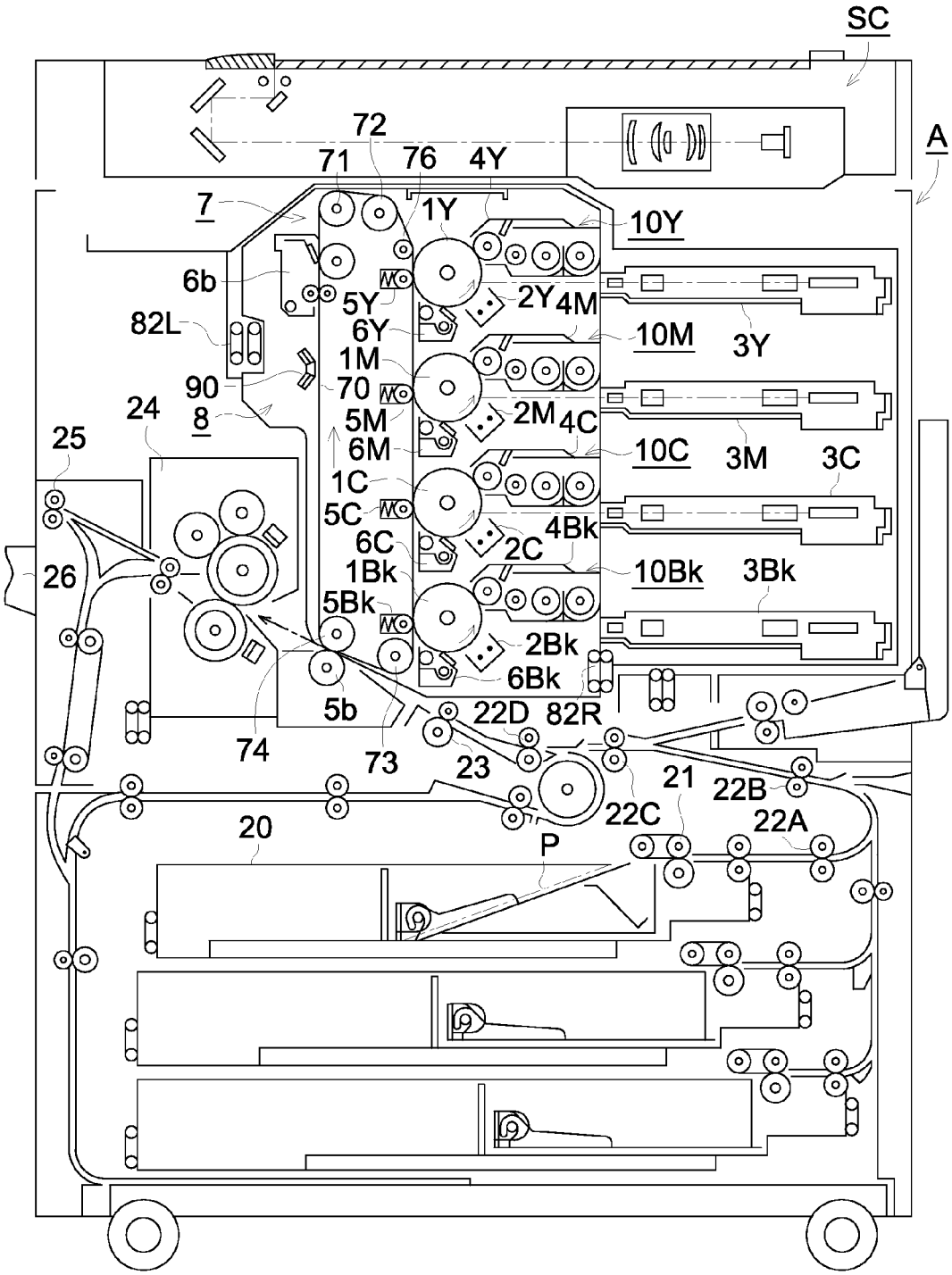
FIG. 2 is a cross-sectional structural view of a color image forming apparatus showing one embodiment of the present invention.

FIG. 2 is a cross sectional constitution view of a color image forming apparatus showing one embodiment of the present invention.

This color image forming apparatus is referred to as a tandem-type color image forming apparatus, and composed of 4 image forming sections (image forming units) 10Y, 10M, 10C, and 10Bk; endless belt-shaped intermediate transfer body unit 7; paper feeding and conveying member 21; and fixing member 24. In the upper part of image forming apparatus main body A, original document image reading unit SC is arranged.

The image forming section 10Y, forming a yellow image, incorporates charging member (charging process) 2Y arranged around drum-shaped photoreceptor 1Y as a first image carrier, exposure member (exposure process) 3Y, developing member (developing process) 4Y, primary transfer roller 5Y as a primary transfer member (primary transfer process), and cleaning member 6Y. Image forming section 10M, forming a magenta image, incorporates drum-shaped photoreceptor 1M as a first image carrier, charging member 2M, exposure member 3M, developing member 4M, primary transfer roller 5M as a primary transfer member, and cleaning member 6M. Image forming section 10C, forming a cyan image, incorporates drum-shaped photoreceptor 1C as a first image carrier, charging member 2C, exposure member 3C, developing member 4C, primary transfer roller 5C as a primary transfer member, and cleaning member 6C. Image forming section 10Bk, forming a black image, incorporates drum-shaped photoreceptor 1Bk as a first image carrier, charging member 2Bk, exposure member 3Bk, developing member 4Bk, primary transfer roller 5Bk as a primary transfer member, and cleaning member 6Bk.

The above-mentioned four image forming units 10Y, 10M, 10C, and 10Bk are composed, around centrally located photoreceptor drums 1Y, 1M, 1C, and 1Bk, of rotatable charging members 2Y, 2M, 2C, and 2Bk; image exposure member 3Y, 3M, 3C, and 3Bk; rotatable developing members 4Y, 4M, 4C, and 4Bk; and cleaning members 5Y, 5M, 5C, and 5Bk cleaning photoreceptor drums 1Y, 1M, 1C, and 1Bk, respectively.

The image forming units 10Y, 10M, 10C, and 10Bk, described above, each have the same constitution only with different toner image colors formed on photoreceptors 1Y, 1M, 1C, and 1Bk. Accordingly, image forming unit 10Y will now be detailed as an example.

In the image forming unit 10Y, around photoreceptor drum 1Y which is an image forming body, there are arranged charging member 2Y (hereinafter referred to simply as charging member 2Y or charging unit 2Y), exposure member 3Y, developing member 4Y, and cleaning member 5Y (hereinafter referred to simply as cleaning member 5Y or cleaning blade 5Y) to form a toner image of yellow (Y) on photoreceptor drum 1Y. Further, in the embodiments of the present invention, with regard to image forming unit 10Y of such a type, at least photoreceptor drum 1Y, charging member 2Y, developing member 4Y, and cleaning member 5Y are provided so as to be unified.

The charging member 2Y is a member to uniformly apply a potential to photoreceptor drum 1Y. In the embodiments of the present invention, the corona discharge-type charging unit 2Y is used for photoreceptor drum 1Y.

The image exposure member 3Y is a member to perform exposure onto photoreceptor drum 1Y, having been provided with a uniform potential by charging unit 2Y, based on image signals (yellow) to form an electrostatic latent image corresponding to a yellow image. For such exposure member 3Y, there can be used those composed of an LED, wherein light-emitting elements are array-arranged in the axial direction of photoreceptor drum 1Y, and an imaging element (trade name: SELFOC lens) or Laser optical system.

The image forming apparatus of the present invention may be constituted in such a manner that components such as a photoreceptor, a developing unit, and a cleaning unit described above are combined into a unit as a process cartridge (image forming unit), and then this image forming unit may be structured so as be fully detachable to the apparatus main body. Further, it is possible to employ the following constitution: a process cartridge (image forming unit) is formed holding at least one of a charging unit, an image exposure unit, a developing unit, a transfer or separation unit, and a cleaning unit together with a photoreceptor to form a single image forming unit fully detachable to the apparatus main body in such a manner that the unit is fully detachable using a guide member such as a rail of the apparatus main body. Herein, "holding at least one of a unit" means that a process cartridge can be attachable and detachable as one unit when a process cartridge is attached and detached.

The endless belt-shaped intermediate transfer body unit 7, which is wound around a plurality of rollers, has endless belt-shaped intermediate transfer body 70 as a semiconductive endless belt-shaped second image carrier which is rotatably held.

Each color image formed by the image forming units 10Y, 10M, 10C, and 10Bk is successively transferred onto rotating endless belt-shaped intermediate transfer body 70 via primary transfer rollers 5Y, 5M, 5C, and 5Bk as primary transfer members to form a composed color image. Transfer material P as a transfer material (a support to carry the final fixed image, for example, plain paper or a transparent sheet) loaded in paper feeding cassette 20 is fed by paper feeding member 21, and passes through a plurality of intermediate rollers 22A, 22B, 22C, and 22D, and registration roller 23, followed by being conveyed by secondary transfer roller 5*b*, serving as a secondary transfer member, whereby secondary transfer is carried out onto transfer material P for collective transferring of several color images. The transfer material P, on which color images have been transferred, is subjected to fixing treatment using fixing member 24, and is nipped by paper discharging rollers 25 and deposited on paper discharging tray 26 outside the apparatus. Herein, a transfer support of a toner image formed on a photoreceptor such as an intermediate transfer body or a transfer material collectively refers to a transfer medium.

On the other hand, after color images are transferred onto transfer material P by secondary transfer roller 5*b* as a secondary transfer member, the residual toner on the endless belt-shaped intermediate transfer body 70, which has been curvature-separated from transfer material P, is removed by cleaning member 6*b*.

During the image formation processing, primary transfer roller 5Bk is always in pressure contact with photoreceptor 1Bk. Other primary transfer rollers 5Y, 5M, and 5C are brought into pressure contact with each of corresponding photoreceptors 1Y, 1M, and 1C only during color image formation.

The secondary transfer roller 5*b* is brought into pressure contact with endless belt-shaped intermediate transfer body 70, only when transfer material P passes a specified position and secondary transfer is carried out.

Further, a chassis 8 is structured so as to be withdrawn from apparatus main body A via supporting rails 82L and 82R.

The chassis 8 is composed of image forming sections 10Y, 10M, 10C, and 10Bk, and endless belt-shaped intermediate transfer body unit 7.

The image forming sections 10Y, 10M, 10C, and 10Bk are tandemly arranged in the perpendicular direction. Endless belt-shaped intermediate transfer body unit 7 is arranged on the left side of photoreceptors 1Y, 1M, 1C, and 1Bk as shown in the drawing. Endless belt-shaped intermediate transfer body unit 7 is composed of rotatable endless belt-shaped intermediate transfer body 70 wound around rollers 71, 72, 73, and 74, primary transfer rollers 5Y, 5M, 5C, and 5Bk, and cleaning member 6*b*.

Figure 3:
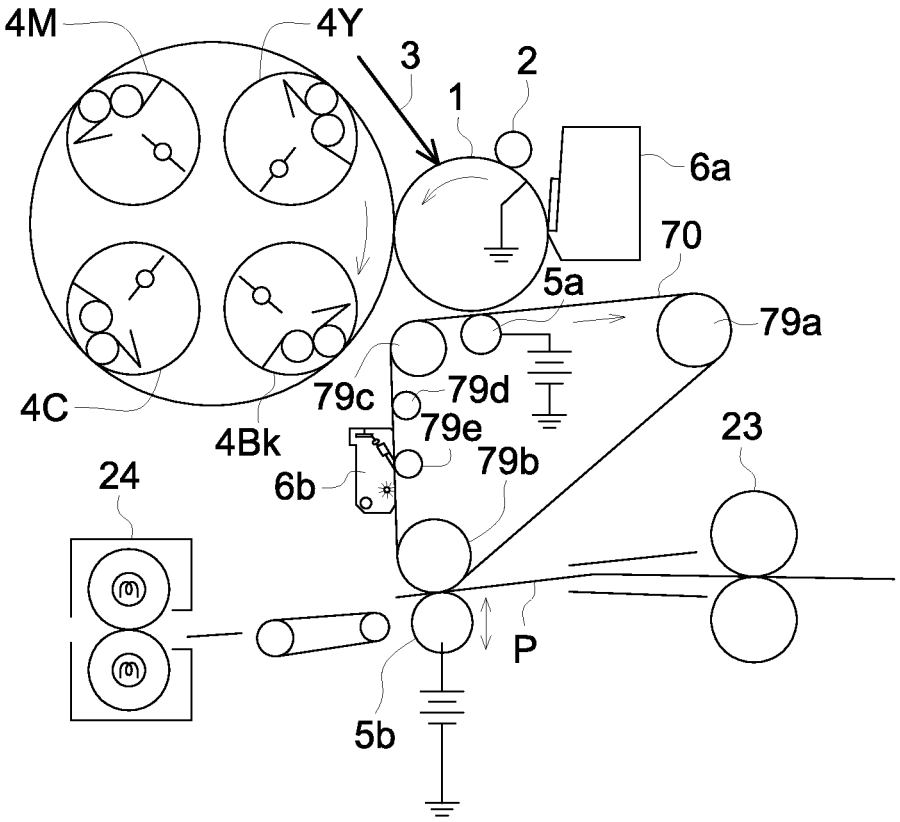
FIG. 3 is a cross-sectional structural view of a color image forming apparatus in which an organic photoreceptor of the present invention is incorporated.

Next, FIG. 3 shows the cross-sectional configuration view diagram of a color image forming apparatus using an organic photoreceptor (a copier or a laser beam printer having at least a charging means, an exposing means, a plurality of developing means, image transfer means, cleaning means, and intermediate image transfer body around the organic photoreceptor). An elastic material with a medium level of electrical resistivity is being used for the belt shaped intermediate image transfer body 70.

In this figure, 1 is a rotating drum type organic photoreceptor that is used repetitively as the image carrying body, and is driven to rotate with a specific circumferential velocity in the anti-clockwise direction shown by the arrow.

During rotation, the organic photoreceptor 1 is charged uniformly to a specific polarity and potential by the charging means (charging process) 2, after which it receives from the image exposing means (image exposing process) 3 not shown in the figure image exposure by the scanning exposure light from a laser beam modulated according to the time-serial electrical digital pixel signal of the image information thereby forming the electrostatic latent image corresponding to the yellow (Y) color component (color information) of the target color image.

Next, this electrostatic latent image is developed by the yellow (Y) developing means: developing process (yellow color developer) 4Y using the yellow toner which is the first color. At this time, the second to the fourth developing means (magenta color developer, cyan color developer, and black color developer) 4M, 4C, and 4Bk are each in the operation switched-off state and do not act on the organic photoreceptor 1, and the yellow toner image of the above first color does not get affected by the above second to fourth developers.

The intermediate image transfer body 70 is wound around the rollers 79*a*, 79*b*, 79*c*, 79*d*, and 79*e* and is driven to rotate in a clockwise direction with the same circumferential speed as the organic photoreceptor 1.

The yellow toner image of the first color formed and retained on the organic photoreceptor 1 is, in the process of passing through the nip section between the organic photoreceptor 1 and the intermediate image transfer body 70, intermediate transferred (primary transferred) successively to the outer peripheral surface of the intermediate image transfer body 70 due to the electric field formed by the primary transfer bias voltage applied from the primary transfer roller 5*a* to the intermediate image transfer body 70.

The surface of the organic photoreceptor 1 after it has completed the transfer of the first color yellow toner image to the intermediate image transfer body 70 is cleaned by the cleaning apparatus 6*a*.

In the following, in a manner similar to the above, the second color magenta toner image, the third color cyan toner image, and the fourth color black toner image are transferred successively on to the intermediate image transfer body 70 in a superimposing manner, thereby forming the superimposed color toner image corresponding to the desired color image.

The secondary transfer roller 5*b* is placed so that it is supported by bearings parallel to the secondary transfer opposing roller 79*b* and pushes against the intermediate image transfer body 70 from below in a separable condition.

In order to carry out successive overlapping transfer of the toner images of the first to fourth colors from the organic photoreceptor 1 to the intermediate image transfer body 70, the primary transfer bias voltage applied has a polarity opposite to that of the toner and is applied from the bias power supply. This applied voltage is, for example, in the range of +100V to +2 kV.

During the primary transfer process of transferring the first to the third color toner image from the organic photoreceptor 1 to the intermediate image transfer body 70, the secondary transfer roller 5*b* and the intermediate image transfer body cleaning means 6*b* can be separated from the intermediate image transfer body 70.

The transfer of the superimposed color toner image transferred on to the belt shaped intermediate image transfer body on to the transfer material P which is the second image supporting body is done when the secondary transfer roller 5*b* is in contact with the belt of the intermediate image transfer body 70, and the transfer material P is fed from the corresponding sheet feeding resist roller 23 via the transfer sheet guide to the contacting nip between the secondary transfer roller 5*b* and the intermediate image transfer body 70 at a specific timing. The secondary transfer bias voltage is applied from the bias power supply to the secondary image transfer roller 5*b*. Because of this secondary transfer bias voltage, the superimposed color toner image is transferred (secondary transfer) from the intermediate image transfer body 70 to the transfer material P which is the second image supporting body. The transfer material P which has received the transfer of the toner image is guided to the fixing means 24 and is heated and fixed there.

The image forming method according to the present invention can be applied in general to all electro-photographic apparatuses such as electro-photographic copiers, laser printers, LED printers, and liquid crystal shutter type printers, and in addition, it is also possible to apply the present invention to a wide range of apparatuses applying electro photographic technology, such as displays, recorders, light printing equipment, printing screen production, and facsimile equipment.

EXAMPLE

Hereafter, the present invention will be explained in detail with reference to typical embodiments of the present invention. However, of course, the aspect of the present invention is not limited to these embodiments. In addition, in the following description, "part" represents "part by weight".

[Production of Photoreceptor 1]

Photoreceptor 1 was produced in the following ways.

The surface of a cylindrical aluminum support with a diameter of 60 mm was subjected to a cutting process, whereby a conductive support with a surface roughness (Rz=1.5 (μm)) was prepared.

| <Intermediate layer> An intermediate layer coating liquid with the following composition was produced. | |
|---|---|
| Polyamide resin X1010 (produced by Daicel Degussa Co., Ltd.) | 1 part |
| Titanium oxide SMT500SAS (produced by TAYCA Corporation) | 1.1 parts |
| Ethanol | 20 parts |

The above materials were dispersed for 10 hours in a batch process by the use of Sand mill as a dispersing apparatus.

The above coating liquid was coated on the above support by the dip coating method so that an intermediate layer was formed with a dry layer thickness of 2.0 μm after a drying process at 110° C. for 20 minutes.

| <Charge generating layer> | |
|---|---|
| Charge generating material: Titanyl phthalocyanine pigment (a titanyl phthalocyanine pigment which has the maximum diffraction peak at a position of at least 27.3 in the Cu—Kα characteristic X-ray diffraction spectrum measurement) | 20 parts |
| Polyvinyl butyral resin (#6000-C: produced by DENKI KAGAKU KOGYO K.K.) | 10 parts |
| Acetic acid t-butyl | 700 parts |
| 4-methoxy-4-methyl-2-pentanone | 300 parts |

The above materials were mixed and dispersed for 10 hours by the use of Sand mill, whereby a charge generating layer coating liquid was prepared.

This coating liquid was coated on the above intermediate layer by the dip coating method so that a charge generating layer was formed with a dry layer thickness of 0.3 μm.

| <Charge transport layer> | |
|---|---|
| Charge transporting substance: CTM (the following Compound C) | 150 parts |
| Binder: Polycarbonate (Z300: produced by Mitsubishi Gas Chemical Co., Inc.) | 300 parts |
| Antioxidant (Irganox 1010: produced by Japan Ciba-Geigy Corporation) | 6 parts |
| Toluene/tetrahydrofuran = 1/9 volume % | 2000 parts |
| Silicone oil (KF-54: produced by the Shinetsu Chemical Co., Ltd) | 1 part |

The above materials were mixed and dissolved, whereby a charge transport layer coating liquid was prepared. This coating liquid was coated on the above charge generating layer by dip coating method, whereby a charge transport layer with a dry layer thickness of 20 μm was formed after a drying process at 110° C. for 60 minutes.

Compound C

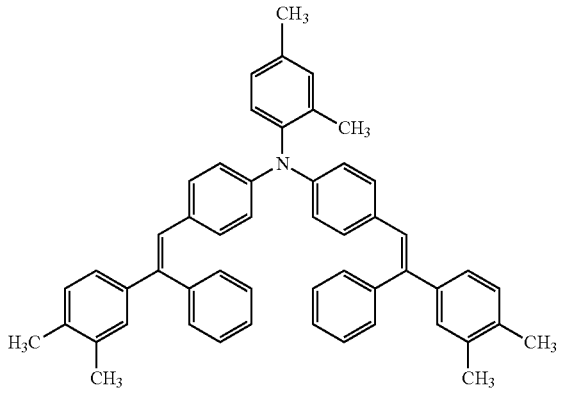

| <Protective layer> | |
|---|---|
| Alumina particles having been subjected to a surface treatment with a compound A having a reactive functional group (γ-alumina particles which was subjected to a surface treatment with 30 parts of methacryloxypropyl trimethoxysilan to 100 parts of alumina particles and contains 10 ppm of phosphorus atoms having a number-based particle size of 20 nm) | 100 parts |
| Curable compound B (exemplary compound No. 42) | 100 parts |
| Isopropyl alcohol | 500 parts |

The above materials were mixed and dispersed for 10 hours by the use of Sand mill, and then the resultant dispersion was added, mixed with 30 parts of Polymerization initiator 3-2, and dispersed under a light shielding condition, whereby a protective layer coating liquid was prepared (it was preserved under a light shielding condition). The thus-obtained coating liquid was coated by the use of a circular slide hopper coating device on the photoreceptor on which the charge transport layer and like were formed previously. After the coating, the coating layer was dried for 20 minutes at a room temperature (solvent drying process). Thereafter, the coating layer was irradiated for one minutes from 100 mm with ultraviolet rays by the use of a metal halide lamp (500 W) while the photoreceptor is being rotated (ultraviolet ray curing process), whereby a protective layer with a thickness of 3 μm was four red.

[Production of Photoreceptors 2 to 12]

Subsequently, Photoreceptors 2 to 12 were produced in the same ways as that for Photoreceptor 1 except that the particle size of alumina, the content of phosphorus atoms and sodium atoms, the surface treatment agent and the curing condition employed for the protective layer of Photoreceptor 1 were changed as shown in the following Table 1.

With regard to the crystal form of alumina, γ-alumina was used for Photoreceptors 1 to 11 and α-alumina was used for Photoreceptors 12.

Curing condition (light): the respective coating layers were irradiated for one minutes from 100 mm by the use of a metal halide lamp (500 W) while the photoreceptor is being rotated (ultraviolet ray curing process), whereby the respective protective layers with a thickness of 3 μm were formed.

Curing condition (heat): the respective coating layers were heated for 30 minutes at 140° C., whereby the respective protective layers with a thickness of 3 μm were formed.

[Production of Photoreceptors 13]

Photoreceptors 13 was produced in the same ways as that for Photoreceptor 1 except that the content of phosphorus atoms in the γ-alumina particles in the protective layer was made to 1 ppm.

[Production of Photoreceptors 14]

Photoreceptors 14 was produced in the same ways as that for Photoreceptor 1 except that the content of phosphorus atoms in the γ-alumina particles in the protective layer was made to 60 ppm.

[Production of Photoreceptors 15]

Photoreceptors 15 was produced in the same ways as that for Photoreceptor 1 except that the γ-alumina particles were eliminated from the protective layer.

[Production of Photoreceptors 16]

Photoreceptors 16 was produced in the same ways as that for Photoreceptor 1 except that the surface treatment agent for the γ-alumina particles in the protective layer was changed to isobutyl trimethoxysilan (a surface treatment not having a reactive functional group) and polyarylate was used for the binder of the protective layer.

[Production of Photoreceptors 17]

Photoreceptors 17 was produced in the same ways as that for Photoreceptor 1 except that the surface treatment agent for the γ-alumina particles in the protective layer was changed to isobutyl trimethoxysilan (a surface treatment not having a reactive functional group).

TABLE 1

| | Alumina particles subjected to a surface treatment with a compound having a reactive functional group | | | | | Curable compound | | Polymerization initiator | | |
|---|---|---|---|---|---|---|---|---|---|---|
| Photoreceptor No. | Content of P (ppm) | Content of Na (ppm) | Number- cased 50% particle size (nm) | Surface treatment agent | Agent (parts)/ alumina particles (parts) | Exemplary compound | Number of functional groups | Exemplary compound | Parts | Curing condition |
| 1 | 10 | 20 | 20 | S-15 | 30/100 | 42 | 3 | 3-2 | 10 | light |
| 2 | 2 | 10 | 30 | S-5 | 100/100 | 44 | 6 | 1-6 | 20 | light |
| 3 | 20 | 5 | 30 | S-13 | 20/100 | 1 | 3 | 1-5 | 0.1 | light |
| 4 | 40 | 20 | 30 | S-15 | 10/100 | 10 | 3 | 3-1 | 10 | light |
| 5 | 50 | 10 | 30 | S-30 | 30/100 | 43 | 4 | 1-5 | 15 | light |
| 6 | 10 | 20 | 10 | S-7 | 30/100 | 31 | 4 | 3-2 | 1 | light |
| 7 | 10 | 25 | 100 | S-7 | 20/100 | 31 | 4 | 5-1 | 10 | heat |
| 8 | 10 | 15 | 30 | S-15 | 5/100 | 43 | 6 | 5-1 | 10 | heat |
| 9 | 10 | 30 | 30 | S-30 | 10/100 | 42 | 3 | 4-1 | 5 | light |
| 10 | 10 | 20 | 30 | S-22 | 50/100 | 1 | 3 | 1-5 | 15 | light |
| 11 | 10 | 10 | 5 | S-16 | 30/100 | 31 | 4 | 1-5 | 10 | light |
| 12 | 10 | 10 | 120 | S-15 | 20/100 | 31 | 4 | 1-5 | 10 | light |

TABLE 1-continued

| Photoreceptor No. | Alumina particles subjected to a surface treatment with a compound having a reactive functional group: Content of P (ppm) | Content of Na (ppm) | Number- cased 50% particle size (nm) | Surface treatment agent | Agent (parts)/ alumina particles (parts) | Curable compound: Exemplary compound | Number of functional groups | Polymerization initiator: Exemplary compound | Parts | Curing condition |
|---|---|---|---|---|---|---|---|---|---|---|
| 13 | 1 | 20 | 20 | S-15 | 30/100 | 42 | 3 | 3-2 | 10 | light |
| 14 | 60 | 20 | 20 | S-15 | 30/100 | 42 | 3 | 3-2 | 10 | light |
| 15 | — | — | — | — | — | 42 | 3 | 3-2 | 10 | light |
| 16 | 10 | 20 | 20 | *A | 30/100 | Polyarylate | — | — | — | — |
| 17 | 10 | 20 | 20 | *A | 30/100 | 42 | 3 | 3-2 | 10 | light |

*A: Isobutyl trimethoxysilan

<Evaluation of Photoreceptors]

(Repetition Electric Potential Characteristics)

Next, the electric potential (Vd) of an initial dark section and the electric potential (Vl) of an initial light section were set to about −700V and −100V respectively, and then charging and exposing were repeated 100000 times by the use of a monochromatic light with a wavelength of 780 nm, the fluctuation amount (ΔVd, ΔVl) of Vd, Vl was measured.

In the fluctuation amount (ΔVd, ΔVl), if a change (a difference for an initial value) after the repeating operation is 150 V or less, such a change is practically usable.

AA: A change of a remaining elects is potential after an actual print operation is less than +50 V (good).

A: A change of a remaining electric potential after an actual print operation is +50 V to less than +100 V (practically with no problem).

B: A change of a remaining electric potential after an actual print operation is +100 V to +150 V (possible to use practically).

C: A change of a remaining electric potential after an actual print operation is more than +150 V (problem in practical use.

The above results are shown in Table 1.

In the above, the above plus sign expresses a rise of electric potential.

(Surface Flaw)

Each produced Photoreceptor was evaluated in the following ways.

In order to conduct evaluation, a tandem type color compound machine bizhub PRO C6500 manufactured by Konica Minolta Business Technologies (laser exposure with a wavelength of 780 nm, reversal development, an intermediate transfer member) was modified to an evaluating machine in which exposure amount is adjusted adequately. The Photoreceptors were mounted on the evaluating machine, and the printing test was conducted with the Photoreceptors such that an A4 image with a printing rate of 2.5% for each color of Y, M, C, Bk was printed under an environment of 20° C., 50% RH onto 1,000,000 sheets of neutralized paper. Thereafter, the surface condition of each of the Photoreceptors was compared between before and after the printing so as to evaluate the state of flaw. The Photoreceptors to be evaluated were mounted at a position of cyan color.

AA: There was no surface flaw after the one million sheet printing (good).

A: The surface flaw took place at 1 to 10 points after the one million sheet printing (practically with no problem).

C: The surface flaw took place at more than 11 points after the one million sheet printing (practically with problems).

(Amount of Wear of Photoreceptors)

In the above evaluation, an image was printed on one million sheets, and a difference between the initial thickness of a layer between the surface of the photoreceptor and the surface of the conductive support and the thickness of the layer after the one million sheet printing was evaluated as an amount of wear. The thickness of the layer between the surface of the photoreceptor and the surface of the conductive support was measured at ten points randomly on a uniform thickness portion (except a region within 3 cm from both sides, because the thickness tends to become uneven on the both sides of the photoreceptor), and the average of the ten measurements was made as the thickness of the layer between the surface of the photoreceptor and the surface of the conductive support. As such a film thickness gauge, employed was an eddy electric current type film thickness gage EDDY560C (manufactured by HELMUT FISCHER GMBTE Co., Ltd.), and the difference in the thickness of the above layer between before and after an actual printing test was made as an amount of wear of the layer thickness.

AA: An amount of wear was 1 μm or less (good).

A: An amount of wear was 1 μm to 3 μm (practically with no problem).

C: An amount of wear was larger than 3 μm (practically with problems).

(Image Blurring)

With the same evaluation condition as that in Surface flaw except that the environmental condition was changed into 30° C. and 80% RH, an A4 image was printed on 25,000 sheets of neutralized paper, and then at 60 seconds after the printing was finished, the main power source of the evaluating machine was turned OFF. Subsequently, at 12 hours after the main power was turned OFF, the main power was turned ON, and immediately after the evaluating machine became a condition capable of printing, a halftone image (with a relative reflection density of 0.4 by the use of Macbeth densitometer) was printed on an entire surface of an A3 neutralized paper and a 6 dot lattice image was printed on an entire surface of an A3 neutralized paper. The states of the printed images were observed and evaluated in the following ways.

AA: The half-tone and the lattice image had no image blur occurrence (good).

A: Only on the halftone image, a thin belt-like density lowering was observed in the longitudinal direction of the photoreceptor (practically with no problem).

C: Defects of the lattice image or shrinking of line width due to image blurring occurred (practically with problems).

The evaluation results are summarized in the following Table 2.

TABLE 2

| Photoreceptor No. | Repetition electric potential characteristics: Amount of fluctuation (ΔVd) | Repetition electric potential characteristics: Amount of fluctuation (ΔVl) | Surface flaw | Amount of wear | Image blurring | Remarks |
|---|---|---|---|---|---|---|
| 1 | AA | AA | AA | AA | AA | Within the invention |
| 2 | AA | A | A | AA | AA | Within the invention |
| 3 | A | A | AA | AA | A | Within the invention |
| 4 | A | AA | AA | A | AA | Within the invention |
| 5 | AA | AA | A | AA | AA | Within the invention |
| 6 | AA | A | A | A | AA | Within the invention |
| 7 | B | A | A | A | A | Within the invention |
| 8 | A | B | A | A | A | Within the invention |
| 9 | AA | AA | AA | AA | AA | Within the invention |
| 10 | A | AA | AA | AA | A | Within the invention |
| 11 | B | B | A | A | A | Within the invention |
| 12 | B | B | A | A | A | Within the invention |
| 13 | C | C | A | A | C | Comparative example |
| 14 | C | C | A | A | C | Comparative example |
| 15 | C | C | C | C | C | Comparative example |
| 16 | C | C | C | C | A | Comparative example |
| 17 | C | C | A | A | C | Comparative example |

As clear from Table 2, in Photoreceptors 1 to 12 according to the present invention, the evaluation of practically usable or more was obtained. However, in Comparative Photoreceptors 13 to 17, the evaluation resulted in that there were practically problems.

The abovementioned embodiments to attain the objects of the present invention can be summarized as follows from the another view point of the present invention.

1. In an organic photoreceptor which has a photosensitive layer on a conductive substrate and has a protective layer on the photosensitive layer, the organic photoreceptor is characterized in that the protective layer is formed by reacting and curing of alumina particles and a curable compound B, wherein the alumina particles are subjected to a surface treatment with at least a compound A having a reactive functional group and contain 2 to 50 ppm of phosphorus atoms.
2. The organic photoreceptor described in claim 1 is characterized that the 50% particle size in number basis of the alumina particles is 10 to 100 nm.
3. The organic photoreceptor described in claim 1 or 2 is characterized that the compound having a reactive functional group is a compound having a double bond between carbon and carbon (hereafter referred to as a carbon-carbon double) bond and a silyl group.
4. The organic photoreceptor described in any one of claims 1 to 3 is characterized that the curable compound B is a compound having a carbon-carbon double bond.
5. The organic photoreceptor described in claim 4 is characterized that the compound having a carbon-carbon double bond is a compound having an acryloyl group or a methacryloyl group.
6. In an image forming apparatus which comprises at least an electrically charging section, an exposing section and a developing section around an organic photoreceptor and conducts an image formation repeatedly, the image forming apparatus is characterized in that the organic photoreceptor is an organic photoreceptor described in any one of claims 1 to 5.
7. In a process cartridge for use in the image forming apparatus described in claim 6, the process cartridge is characterized in that the process cartridge comprises the organic photoreceptor described in any one of claims 1 to 5 and at least an electrically charging section, an exposing section and a developing section as one body and is structured to be mounted detachably in the image forming apparatus.

The employment of an organic photoreceptor of the present invention can improve remarkably the strength of the surface of the organic photoreceptor for abrasion and scratch, and further improve image blurring under the environment of high temperature and high humidity and electrostatic characteristics, such as increase of a remaining electric potential.

What is claimed is:

1. An organic photoreceptor, comprising:

a conductive support;

a photosensitive layer provided on the conductive support; and a protective layer provided on the photosensitive layer, wherein the protective layer contains a curable compound B having a functional group with a carbon-carbon double bond, and alumina particles which contain 2 to 50 ppm of phosphorus atoms and are subjected to a surface treatment with a compound A having a reactive functional group, and the compound A is a silane compound represented by Formula (1):

Formula (1)

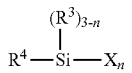

in Formula (1), $R^3$ represents a hydrogen atom, an alkyl group having 1 to 10 carbon atoms or an aralkyl group having 1 to 10 carbon atoms, $R^4$ represents an organic group having a polymerizable double bond, X represents a halogen atom, an alcoxy group, an acyloxy group, an aminoxy group or a phenoxy group, and n represents an integer of 1 to 3, and wherein the protective layer is a cured layer including a cured product formed by at least the compound A on the surface of the alumina particles and the curable compound B such that the compound A and the curable compound B bond with each other through a reaction between the polymerizable double bond of the compound A and the carbon-carbon double bond of the compound B in the cured product material.

2. The organic photoreceptor described in claim 1, wherein the alumina particles have a number-based 50% particle size of 10 to 100 nm.

3. The organic photoreceptor described in claim 1, wherein the alumina particles contain 5 to 30 ppm of sodium atoms.

4. The organic photoreceptor described in claim 1, wherein the alumina particles have a crystal structure of one of γ-alumina, δ-alumina, θ-alumina, and α-alumina.

5. The organic photoreceptor described in claim 1, wherein the alumina particles have a crystal structure of γ-alumina.

6. The organic photoreceptor described in claim 1, wherein $R^4$ represents an organic group having an acryloyl group or a methacryloyl group.

7. The organic photoreceptor described in claim 1, wherein the functional group of the curable compound B is an acryloyl group or a methacryloyl group.

8. The organic photoreceptor described in claim 1, wherein the curable compound B has two or more of the functional group.

9. The organic photoreceptor described in claim 1, wherein the curable compound B has a curable reactive group equivalent weight of 1000 or less.

10. An image forming apparatus, comprising:

the organic photoreceptor described in claim 1;

a charging section, an exposing section, and a developing section which are provided on the periphery of the organic photoreceptor, wherein the image forming apparatus forms images repeatedly.

11. A process cartridge for use in an image forming apparatus, comprising:

the organic photoreceptor described in claim 1; and at least one of a charging section, an exposing section, and a developing section which are provided on the periphery of the organic photoreceptor, wherein the organic photoreceptor, and at least one of a charging section, an exposing section, and a developing section are made in a single body with the process cartridge, and the process cartridge is structured to be mounted detachably in the image forming apparatus.

12. The organic photoreceptor described in claim 1, wherein the curable compound B contains at least one of a styrene type monomer, an acrylic type monomer, a methacrylic type monomer, a vinyltoluene type monomer, a vinyl acetate type monomer, and a N-vinyl-pyrrolidone type monomer.

13. The organic photoreceptor described in claim 1, wherein the curable compound B is at least one of a monomer having a styrene group, a monomer having an acryloyl group, a monomer having a methacryloyl group, a monomer having a vinyltoluene group, a monomer having a vinyl acetate group, and a monomer having an N-vinyl-pyrrolidone group.

* * * * *